US006589068B2

(12) United States Patent
Yu

(10) Patent No.: US 6,589,068 B2
(45) Date of Patent: Jul. 8, 2003

(54) ELECTRICAL CONNECTOR CONNECTING ONE OR MORE FLEXIBLE PRINTED CIRCUITS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/010,299

(22) Filed: Dec. 4, 2001

(65) Prior Publication Data

US 2003/0104721 A1 Jun. 5, 2003

(51) Int. Cl.[7] ..... H01R 9/07
(52) U.S. Cl. ..... 439/495; 439/260
(58) Field of Search ..... 439/492–499, 439/259, 260, 263, 264, 910, 541.5

(56) References Cited

U.S. PATENT DOCUMENTS 5,498,169 A * 3/1996 Ikemoto ..... 439/260
5,501,610 A * 3/1996 Ikemoto ..... 439/498
5,735,709 A * 4/1998 Hashiguchi et al. ..... 439/495
6,272,021 B1 * 8/2001 Nagamine et al. ..... 439/495

* cited by examiner

*Primary Examiner*—Hien Vu
(74) *Attorney, Agent, or Firm*—Wei Te Chung

(57) ABSTRACT

A Flexible Printed Circuit Board (FPC) connector (100) includes an insulative housing (1), a number of first and second terminals (2, 3) and two stuffer members (4). The insulative housing includes a first and a second chambers (14, 15) for receiving the first and the second terminals therein. Two FPCs are respectively inserted into the first and the second chambers for electrically connecting with the first and the second terminals. The stuffer members are respectively inserted into the first and the second chambers for tightly pressing the FPCs against the first and the second terminals.

1 Claim, 6 Drawing Sheets

ELECTRICAL CONNECTOR CONNECTING ONE OR MORE FLEXIBLE PRINTED CIRCUITS

FIELD OF THE INVENTION

The present invention generally relates to an electrical connector, and more particularly to a Flexible Printed Circuit (FPC) connector for connecting two or more FPCs to a Printed Circuit Board (PCB).

BACKGROUND OF THE INVENTION

Flexible Printed Circuit (FPC) connectors are widely used for connecting FPCs to Printed Circuit Boards (PCBs). U.S. Pat. No. 5,474,468 discloses a connector for connecting a flat cable to a PCB. The connector includes an insulating housing having a through opening, a plurality of forked terminals disposed in the opening, and a slide member inserted into the opening. The slide member has a pressing portion extending from a base plate portion thereof for pressing the flat cable against the terminals.

However, the connector can only connect one FPC to the PCB. When it is required to connect two or more FPCs to the PCB, a corresponding number of connectors are needed, and thus occupy more space on the PCB.

Hence, an improved FPC connector is needed to overcome the forgoing shortcomings.

BRIEF SUMMARY OF THE INVENTION

A main object of the present invention is to provide an electrical connector adapted for connecting two or more Flexible Printed Circuits (FPCs) to a Printed Circuit Board (PCB).

Another object of the present invention is to provide an electrical connector which is easy for manufacturing.

A Flexible Printed Circuit (FPC) connector includes an insulative housing, a plurality of first and second terminals and two stuffer members. The insulative housing includes a first and a second chambers for receiving the first and the second terminals therein. Two FPCs are respectively inserted into the first and the second chambers for electrically connecting with the first and the second terminals. The stuffer members are respectively inserted into the first and the second chambers for tightly pressing the FPCs against the first and the second terminals.

Other objects, advantages and novel features of the invention will become more apparent from the following detailed description when taken in conjunction with the accompanying drawings.

DETAILED DESCRIPTION OF THE INVENTION

Figure 1:
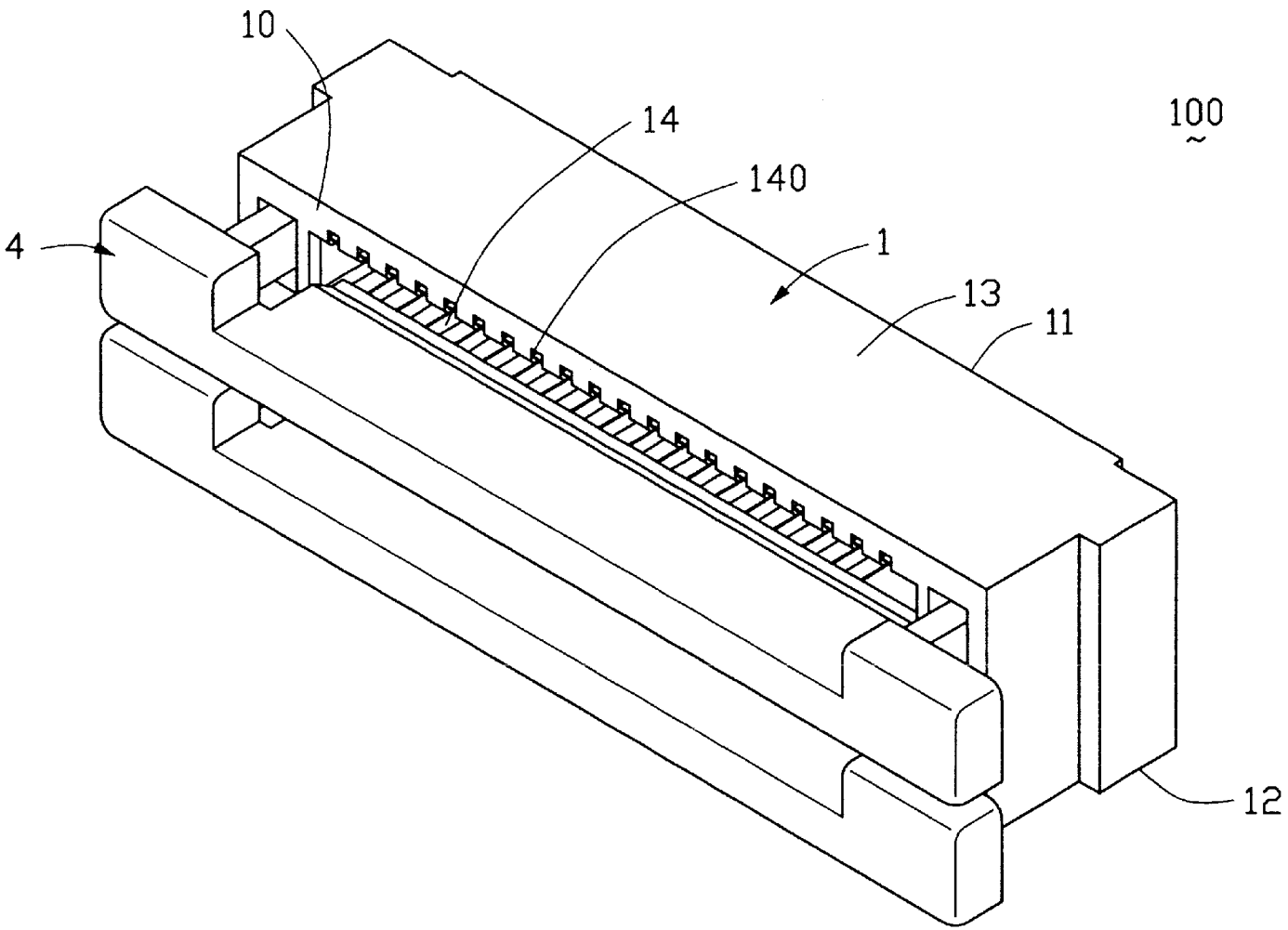
FIG. 1 is a perspective view of a Flexible Printed Circuit (FPC) connector of a preferred embodiment in accordance with the present invention.
Figure 2:
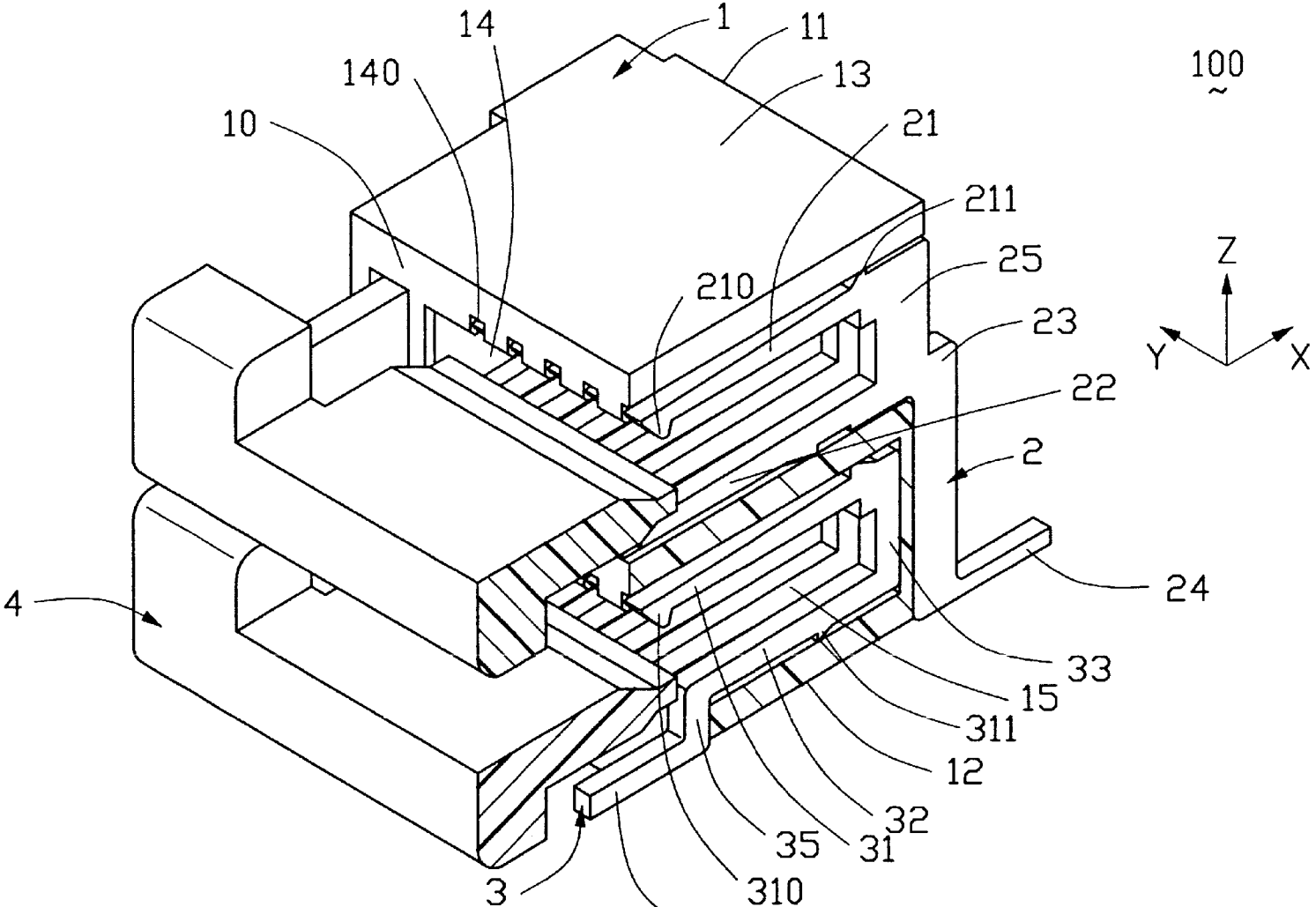
FIG. 2 is a perspective view of the FPC connector of FIG. 1, with a portion thereof cut away to illustrate the inside structure of the FPC connector.

Referring to FIGS. 1 and 2, a Flexible Printed Circuit (FPC) connector 100 in a preferred embodiment according to the present invention includes an insulative housing 1, a plurality of first contacts 2 adapted for connecting to a first FPC (not shown), a plurality of second contacts 3 adapted for connecting to a second FPC (not shown) and two stuffer members 4. Since the structure of the stuffer member 4 is well known to those skilled in the art, a detailed description thereof is omitted herein.

The insulative housing 1 includes a front face 10, a rear face 11 opposite to the front face 10, an upper face 13 connecting the front face 10 with the rear face, and a bottom face 12 opposite to the upper face 13 and adapted for mounting to a Printed Circuit Board (PCB) (not shown). A first and a second chambers 14, 15 are parallel to each other in the Z direction and exposed to the front face 10. An inner wall (not labeled) of each of the first and second chambers 14, 15 defines a plurality of passageways 140 for receiving the first and the second terminals 2, 3.

Each first terminal 2 includes a first spring arm 21, a first retaining portion 22 parallel to the first spring arm 21, a first connecting portion 25 connecting a rear end of the first spring arm 21 with a rear end of the first retaining portion 22, a first vertical portion 23 extending downwardly from the connecting portion 25, and a first solder tail 24 extending perpendicularly from a lower portion of the first vertical portion 23. The first spring arm 21 includes a contact portion 210 on a front end thereof and pointing to the first retaining portion 22. The first spring arm 21 and the first retaining portion 22 include first barbs 211 for locking with the passageways 140 of the first chamber 14.

Each second terminal 3 includes a second spring arm 31, a second retaining portion 32 parallel to the second spring arm 31, a second connecting portion 33 connecting a rear end of the second spring arm 31 and a rear end of the second retaining portion 32, a second vertical portion 35 extending downwardly from a front end of the second retaining portion 32, and a second solder tail 34 extending perpendicularly from a lower portion of the second vertical portion 35. The second spring arm 31 includes a second contact portion 310 on a front portion thereof and pointing to the second retaining portion 32. The second spring arm 31 and the second retaining portion 32 include second barbs 311 for locking with the passageways 140 of the second chamber 15.

In assembly, the first terminals 2 are inserted into the first chamber 14 from the rear face 11, each retained in a corresponding passageway 140. The second terminals 3 are inserted into the second chamber 15 from the front face 10, each retained in a corresponding passageway 140. Each of the first and the second contact portions 210, 310 is disposed to the front face 10. Each of the first and the second barbs 211, 311 locks with bottoms of the passageways 140. The first and the second solder tails 24, 34 respectively extend out of the insulative housing 1 and in the same plane with the mounting face 12 for soldering to the PCB.

In use, the first and the second FPCs are respectively inserted into the first and the second chambers 14, 15 from the front face 10 of the housing 1 and electrically connecting with the first and the second contact portions 210, 310. The two stuffer members 4 are respectively inserted into the first and the second chambers 14, 15 from the front face 10 and tightly press the first and the second FPCs against the first and the second contact portions 210, 310 of the first and the second terminals 2, 3.

Figure 3:
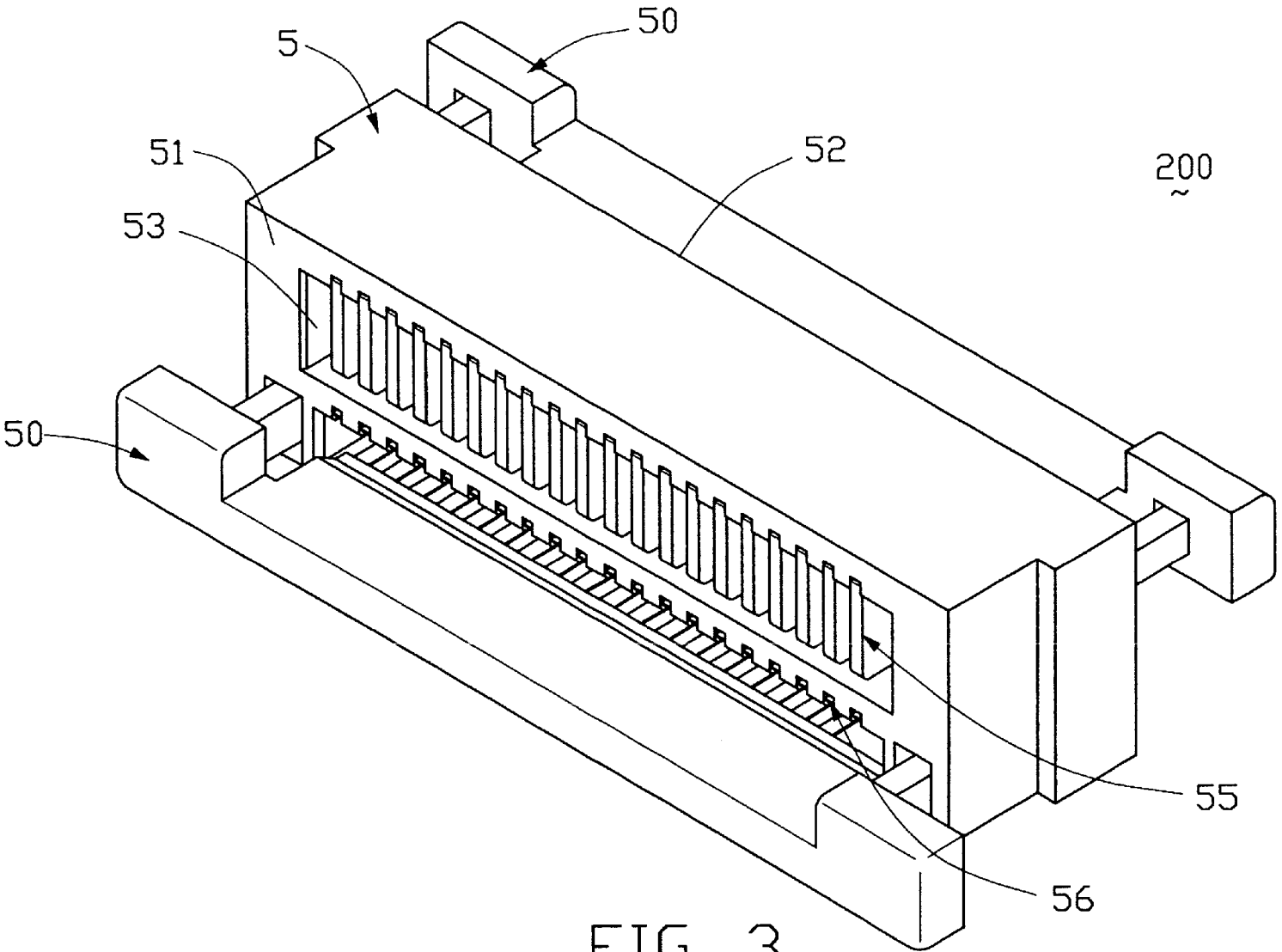
FIG. 3 is a perspective view of a FPC connector of a second embodiment in accordance with the present invention.

FIG. 3 shows an FPC connector 200 corresponding to a second embodiment of the present invention. The FPC connector 200 is similar to the FPC connector 100 in the embodiment mentioned above, except that the first and the second contact portions (not shown) of the first and the second terminals 55, 56 are respectively disposed to the rear and the front faces 52, 51 of the housing 5. The first and the second FPCs are respectively inserted into the first and the second chambers 53, 54 from the rear and the front faces 52, 51. The stuffer members 50 are inserted into the first and the second chambers 53, 54 from the rear and the front faces 52, 51, thereby tightly pressing the first and the second FPCs against the first and the second contact portions.

Figure 4:
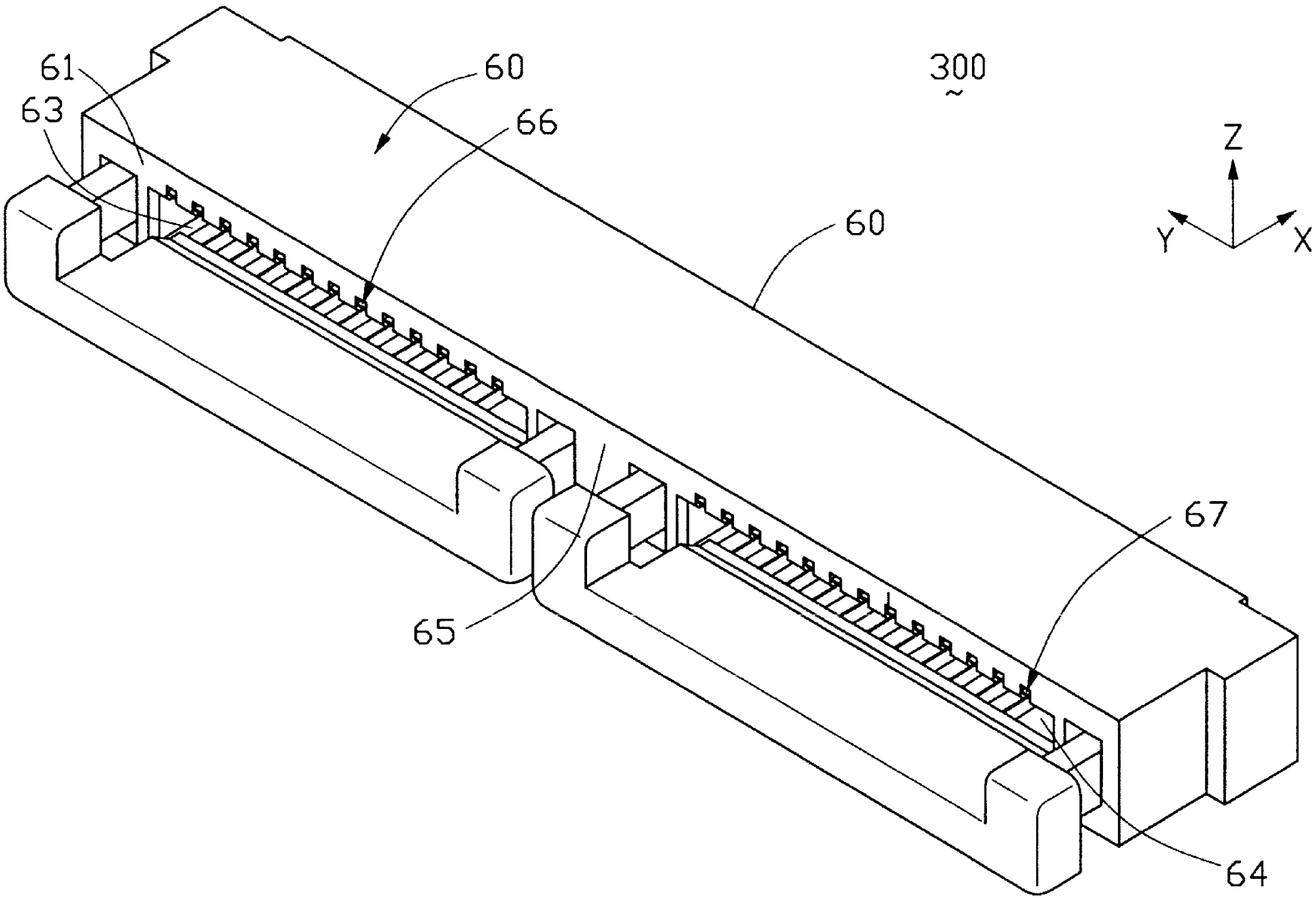
FIG. 4 is a perspective view of a FPC connector of a third embodiment in accordance with the present invention.

FIG. 4 shows a third embodiment of the invention. The FPC connector 300 is similar to the FPC connector 200 of the embodiment mentioned above, except that the first and the second chambers 63, 64 are both exposed to the front face 61 of the housing 60 and in lined with each other in the Y direction with a rib 65 therebetween. The first and the second terminals 66, 67 are respectively inserted into the first and the second chambers 63, 64 with the first and the second contact portions (not shown) disposed to the front face 61.

Figure 5:
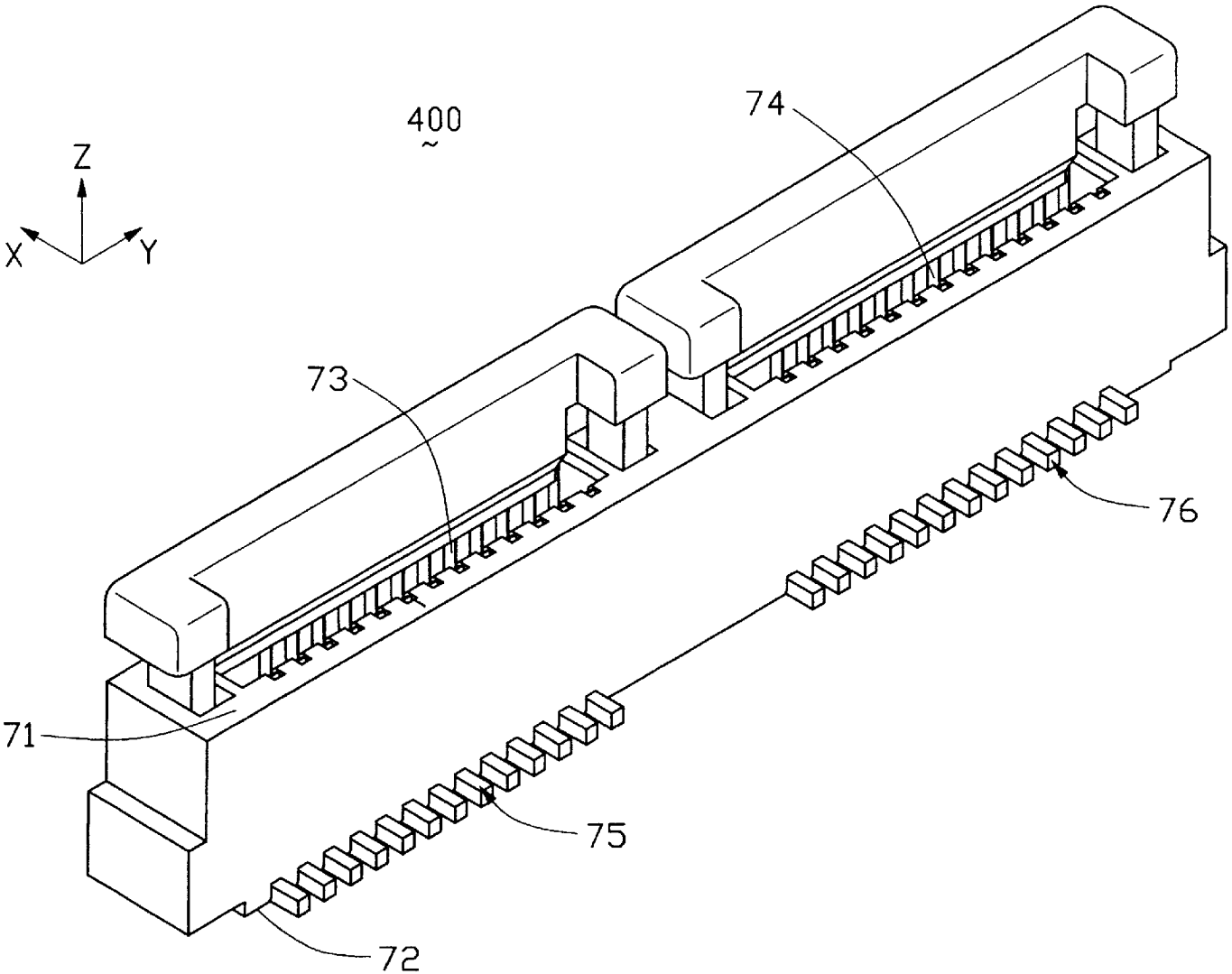
FIG. 5 is a perspective view of a fourth embodiment in accordance with present invention.

FIG. 5 shows still a fourth embodiment of the present invention. An FPC connector 400 is similar to the FPC connector 300 mentioned above, except that the first and the second chambers 73, 74 are in lined to each other in the Y direction through the upper and the bottom faces 71, 72. The first and the second terminals 75, 76 are inserted into the first and the second chambers 73, 74 from the bottom faces 72. The first and the second contact portions (not shown) are disposed to the upper face 71 for electrically connecting with the first and the second FPCs.

Figure 6:
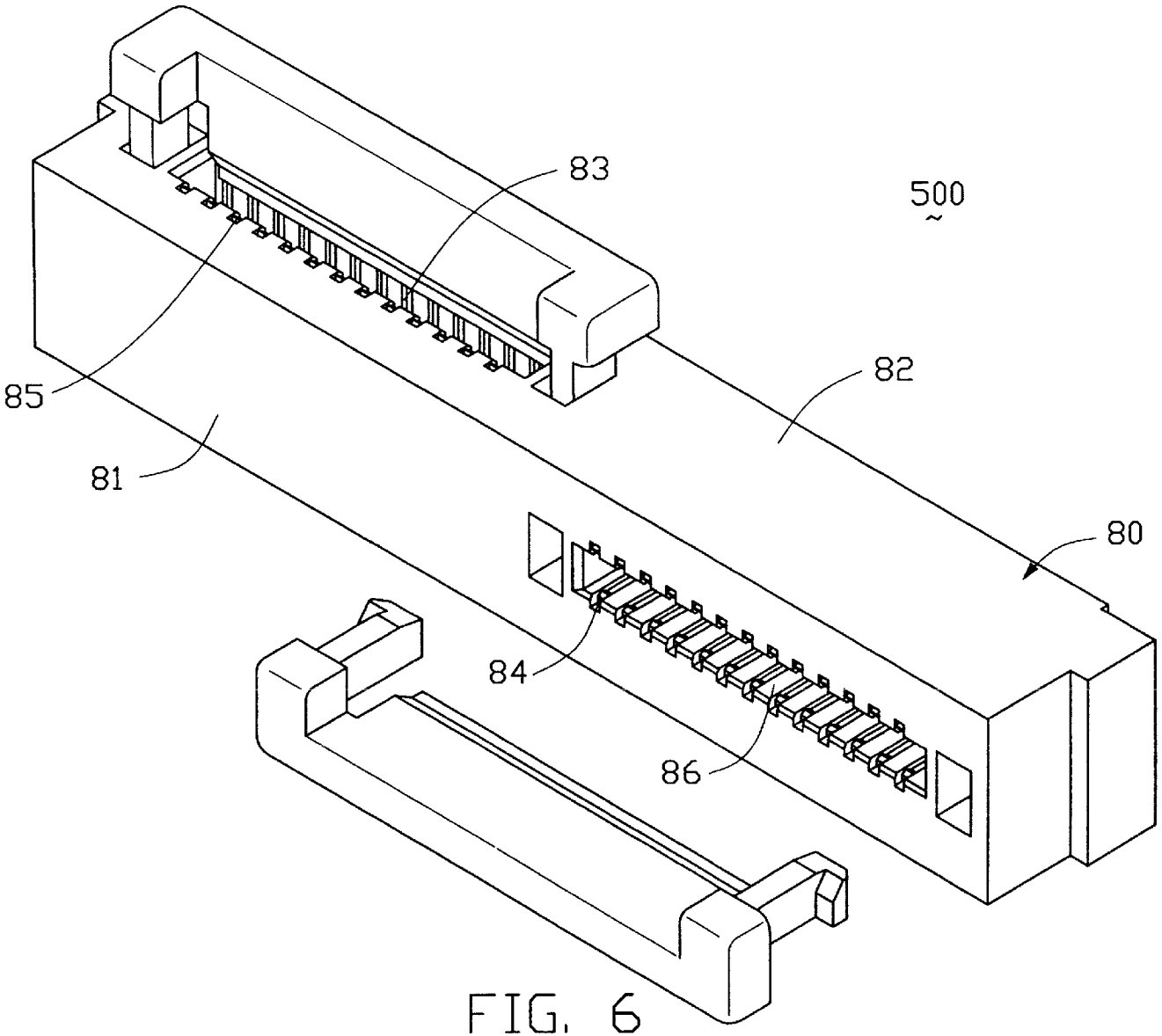
FIG. 6 is a perspective view of a fifth embodiment in accordance with the present invention.

FIG. 6 shows still a fifth embodiment of the present invention. An FPC connecting 500 is similar to the FPC connector 400 mentioned above, expect that the first and the second chambers 83, 84 are respectively exposed to the upper and the front faces 82, 81 of the insulative housing 80. The first and the second contact portions (not shown) of the first and the second terminals 85, 86 are respectively disposed to the upper and the front faces 82, 81.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting two FPCs to a Printed Circuit Board, comprising:

an insulative housing defining first and second receiving slots from a front face thereof;

a row of first contacts received in the first receiving slot, each of said first contacts including a first contact portion extending into the first receiving slot and a first solder portion exposed to an exterior;

a row of second contacts, which are segregated from the row of the first contacts, received in the second receiving slot, each of said second contacts including a second contact portion extending into the second receiving slot and a second solder portion exposed to the exterior;

a first actuator inserted into the first receiving slot and imposing forces upon the first contact portions for pressing inserted flexible printed circuits toward the corresponding first contacts; and a second actuator inserted into the second receiving slot and imposing forces upon the second contact portions for pressing inserted flexible printed circuits toward the corresponding second contacts; wherein said first receiving slot is located above the second receiving slot, and said row of first contacts are located above said row of second contacts; wherein the first solder portions are located around a rear face of the housing, and the second solder portions are located around said front face of the housing through which the second actuator moves in and out.

* * * * *